United States Patent [19]

Kasha

[11] 4,016,793

[45] Apr. 12, 1977

[54] BRIDGE FOR STRINGED MUSICAL INSTRUMENT

[75] Inventor: Michael Kasha, Tallahassee, Fla.

[73] Assignee: Norlin Music, Inc., Lincolnwood, Ill.

[22] Filed: May 12, 1975

[21] Appl. No.: 576,282

[52] U.S. Cl. ..... 84/307; 84/267

[51] Int. Cl.[2] ..... G10D 3/04

[58] Field of Search ..... 84/209, 267, 298, 307–309

[56] References Cited

UNITED STATES PATENTS

| | | | |
|---|---|---|---|
| 2,190,475 | 2/1940 | Gretsch | 84/298 |
| 3,443,465 | 5/1969 | Kasha | 84/307 X |
| 3,474,697 | 10/1969 | Kaman | 84/267 |
| 3,494,239 | 2/1970 | Kasha | 84/309 X |

*Primary Examiner*—John Gonzales

[57] ABSTRACT

This invention relates to an improved bridge for stringed musical instruments which bridge is shaped, for preferred embodiments, so as to provide maximum, and substantially uniform, mechanical compliance between the bridge and the soundboard of the instrument over the full frequency range of the instrument while still being wide enough at each point along its length to effectively couple the frequency of vibrations to be driven by the bridge at that point. For alternative embodiments, the shape of the bridge is altered at one or more selected points along its length, altering the mechanical compliance at these points in a predetermined manner. These variations cause the instruments to have a predetermined frequency response characteristic.

7 Claims, 7 Drawing Figures

BRIDGE FOR STRINGED MUSICAL INSTRUMENT

BACKGROUND

1. Field of the Invention

This invention relates to stringed musical instruments, and more particularly to an improved bridge for use with such instruments.

2. The Prior Art

In stringed musical instruments such as guitars, violins, pianos, and the like, sound is produced by causing one or more tightly stretched strings to vibrate, the frequency at which the string vibrates, and thus the resultant sound output, being dependent on a number of factors including the string length, tension, and string caliper (thickness.) Vibrations of the strings are coupled through a bridge to a soundboard, and through the soundboard to a sound cavity. The strength or intensity of the sound obtained from the instrument is dependent to a large extent on the amplitude of the soundboard vibration. The quality or harmonic spectrum of the sound obtained from the string instrument is dependent to a large extent on the efficiency of driving of the normal modes of the soundboard at each characteristic frequency defined by the soundboard structure.

An important factor in determining the amplitude of soundboard vibration, and thus the response of the instrument at various frequencies, is the efficiency of the coupling between the bridge and soundboard of the instrument at these frequencies. The efficiency of this coupling is governed by mechanical impedance, mechanical impedance being defined formally as the complex ratio of the oscillatory driving force applied by the bridge to the soundboard at a given point to the resulting velocity experienced by the soundboard at the point. Mechanical compliance is essentially the reciprocal of mechanical impedance. Thus, if the bridge of a musical instrument is to transmit effectively a significant vibrational amplitude to the soundboard, the mechanical compliance between the bridge and the soundboard must be high (the mechanical impedance must be low.)

However, it has been found that mechanical impedance is frequency dependent, increasing with frequency. Thus, for effective driving of a soundboard over the many octave range of a musical instrument, the mechanical impedance between the bridge and soundboard has to be frequency adjusted for optimum driving, the bridge being designed so as to be capable of large amplitude low-frequency motion on its bass end and lower amplitude higher-frequency motion on its treble end. The reason for the frequency dependence of the mechanical impedance is that more energy is required to drive a given mass at a higher frequency than at a lower frequency and thus, for a symetrical bridge, the mechanical impedance increases as the frequency increases.

From the above, it is apparent that to minimize impedance, a bridge having minimum mass should be utilized. This is most easily accomplished by utilizing a narrow bridge. However, the bridge must be wide enough to couple the driving force effectively to the soundboard (i.e. to drive a sufficient surface area of the zone of the soundboard to get the fundamental mode driven effectively at respective frequencies.) At low frequencies, a fairly large zone must be driven, and therefore the bridge must be wider, while at higher frequencies the zone being driven is relatively small, and therefore a relatively narrow bridge can be utilized. Thus, fortuitously, the lower impedance at low frequencies permits the use of the wider bridge in the low frequency region which is required to effectively drive the large zone being driven at low frequencies without resulting in unacceptable mechanical impedance levels, while, in the higher frequency regions, where mechanical impedance is greater, a narrow bridge may be utilized since only a small zone of the soundboard is favorable driven at the higher frequencies for a soundboard correspondingly structured to be frequency-dependent. The width of the bridge in the low frequency region is limited by the fact that if the bridge is too large, unacceptable mechanical impedance levels will result and the bridge will serve to stiffen the soundboard, preventing it from vibrating effectively, while if the bridge is too narrow in this region, it will not couple effectively. At the high-frequency end, the bridge should be made as narrow as possible without impairing its ability to couple effectively or adding undue mechanical strain to the soundboard.

From the above, it is apparent that the symetrical bridges of uniform width (and other mechanical parameters) which have heretofore been utilized on most stringed musical instruments have a significantly higher mechanical impedance at their treble end than at their bass end and thus have a nonuniform frequency response, being particularly weak in the treble register. Further, in order to achieve a reasonable treble response, the width of these bridges is not normally sufficient to effectively couple at the bass end of the bridge resulting in a corresponding degradation in the bass response as well. These instruments thus provide an uneven frequency response which is significantly below optimal at all frequencies.

U.S. Pat. No. 3,443,465 titled "Guitar Construction" issued to this inventor on May 13, 1969 does teach the use of a somewhat asymmetrical bridge. However, this patent is primarily concerned with providing a bridge with separate bass and treble regions which are decoupled from each other and, while this patent does show a bridge which is wider at its bass end that at its treble end, it does not disclose the specific structures shown and claimed herein.

SUMMARY OF THE PRESENT INVENTION

In accordance with the above, this invention provides a bridge for a stringed musical instrument of the type having low frequency or bass strings and higher frequency or treble strings, vibrations of the strings being coupled through the bridge to a soundboard. The mechanical compliance between the bridge and the soundboard at each point along the bridge from the bass end thereof to the treble end thereof is dependent on the frequency being coupled by the bridge to the soundboard at that point. The mechanical parameters of the bridge are such that there is a predetermined mechanical compliance between the bridge and the soundboard at each point along the bridge. For a preferred embodiment, the mechanical compliance is substantially the same at all of such points. For preferred embodiments, the parameters of the bridge which is varied is its width, (measured in the plane of the soundboard, perpendicular to its axis) the bridge having a first predetermined width at the bass end thereof which width is sufficient to effectively couple the lowest frequency vibrations to be coupled by the bridge and a second predetermined width at the treble end thereof which width is less than the first width and is sufficient to effectively couple the highest frequency vibrations to be coupled by the bridge. The width at each point intermediate the bass and treble ends of the bridge is both sufficient to effectively couple the frequency coupled at that point and to provide a selected mechanical compliance at that point. For preferred embodiments of the invention, the width of the bridge at each point is selected such that the mechanical compliance between the bridge and the soundboard is substantially the same at all points along the bridge. The width of the bridge at each point may also be selected such that the mechanical compliance at that point is as large as possible while still being of sufficient width to effectively couple the frequency coupled at that point. For an alternative embodiment of the invention, the width of the bridge at first selected points along the length thereof is such as to provide a relatively high mechanical compliance while the width of the bridge at second selected points are such as to provide a lower mechanical compliance, the bridge thus being adapted to provide a predetermined frequency response from the instrument.

The foregoing and other objects, features and advantages of the invention will be apparent from the following more particular description of preferred embodiments of the invention as illustrated in the accompanying drawings.

DETAILED DESCRIPTION

Figure 1:
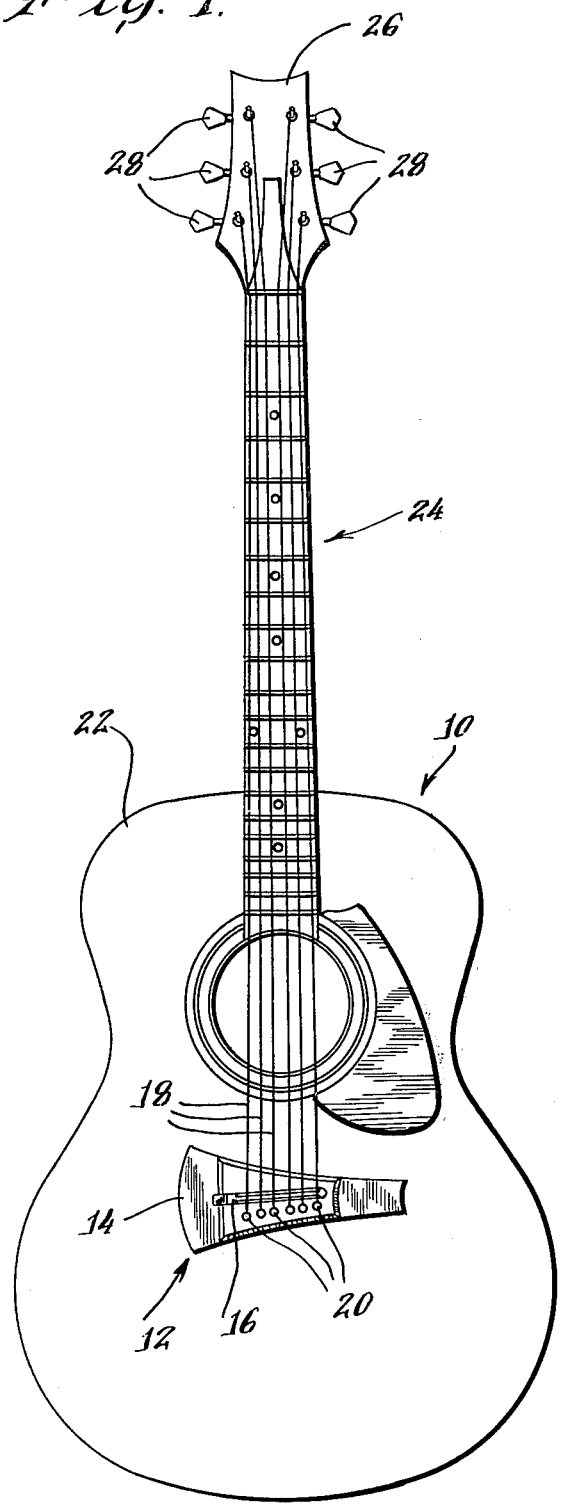
FIG. 1 is a top view of a guitar showing the bridge of an illustrative embodiment of this invention as it might be utilized therein.

Referring now to FIG. 1, a guitar 10 utilizing a bridge 12 of a preferred embodiment of the invention is shown. While the discussion to follow will be with respect to guitar embodiments, it should be understood that this is primarily for purposes of illustration, and that the teachings of this invention may be practiced with other stringed musical instruments as well. Bridge 12 has a bridge base 14 with a bridge saddle 16 projecting therefrom. Strings 18 pass over bridge saddle 16 and are secured at their lower end by pins 20. Bridge base 14 is mounted on soundboard 22, the soundboard forming the upper surface of the guitar body. A neck 24 extends from the guitar body and terminates in a peghead 26. Strings 18 are tightly stretched between pegs 28 in peghead 26 and pins 20. In FIG. 1, the left-most string is the bass or lowest frequency string and the right-most string is the treble or highest frequency string, each string being of higher frequency than the string to the left thereof.

Figure 2:
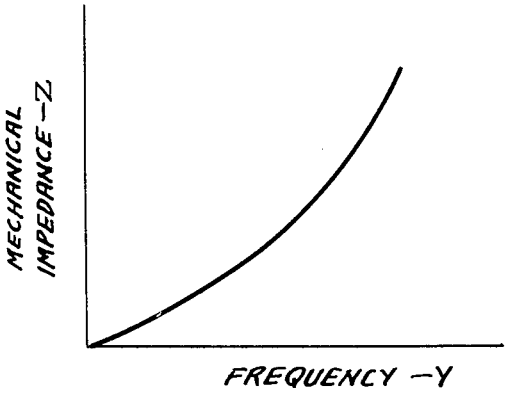
FIG. 2 is a diagram illustrating the relationship between frequency and mechanical impedance for a bridge having uniform parameters.

When one or more of the strings 18 are caused to vibrate, the vibration of the strings is coupled through bridge saddle 16 to bridge base 14 and through the bridge base to soundboard 22. As previously indicated, the efficiency of the coupling between bridge base 14 and soundboard 22 is defined by the mechanical impedance (or its reciprocal mechanical compliance) between these elements. FIG. 2 is a diagram illustrating the frequency dependence of mechanical impedance, mechanical impedance increasing with increasing frequency for a symmetrical bridge. The reason for this is that it takes more energy to drive a given mass at a higher frequency than it does at a lower frequency.

Figure 3:
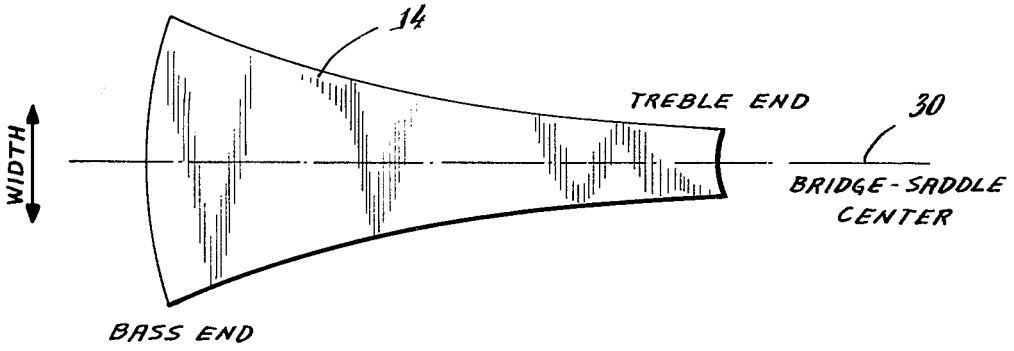
FIG. 3 is an enlarged top view of the profile of a bridge base for the embodiment of the invention shown in FIG. 1.

Referring now to FIG. 3, the profile for a bridge base of a preferred embodiment of the invention is shown. For this embodiment of the invention, the parameter of the bridge which is controlled to obtain desired mechanical impedances (or its inverse, mechanical compliance) at each point along the length of the bridge is the bridge width. Thus, the bridge is widest at its bass end and narrower at its treble end, the profile of the bridge between these two ends being such that a plot of bridge width versus frequency would be roughly the inverse of the curve shown in FIG. 2. The bridge 14 is symmetrical (i.e. has substantially equal mass) about the bridge saddle center line 30. With the bridge profile shown in FIG. 3, the mechanical impedance, and thus the mechanical compliance, between the bridge and soundboard 22 is substantially the same at all points along the bridge length. The width of the bridge at the bass and treble ends thereof and at each point inbetween is also sufficient to effectively drive soundboard 22 at the frequency being coupled by the bridge at that point. Thus, bridge 14 is effective to provide a substantially uniform frequency response from the guitar 10 over the full frequency range of the instrument. It should also be noted that the natural elasticity of the material utilized in constructing the bridge permits a certain amount of independent twisting, thus decoupling the portions of the bridge vibrating at lower frequency from those vibrating at higher frequency.

Figure 4:
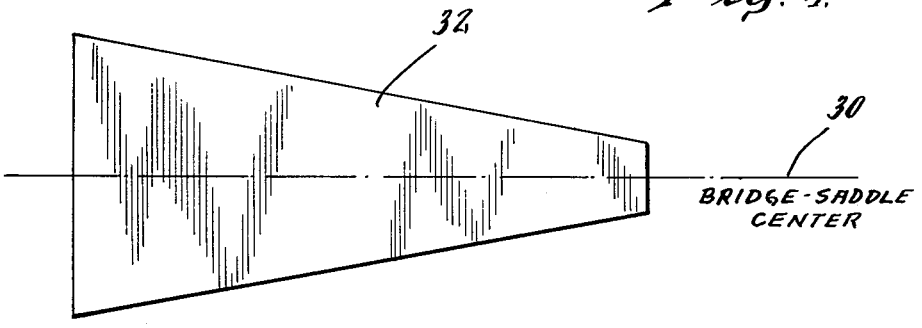
FIG. 4 is a top view of the profile of a bridge base of a first alternative embodiment of the invention.

FIG. 4 shows the profile of a bridge base 32 which is a straight line approximation to the profile 14 shown in FIG. 3. While with this profile, the mechanical compliance is not exactly uniform at all points along the bridge, this bridge is less expensive to design and construct and, for reasons indicated above, still offers superior performance to the symmetrical bridges presently utilized.

Figure 5:
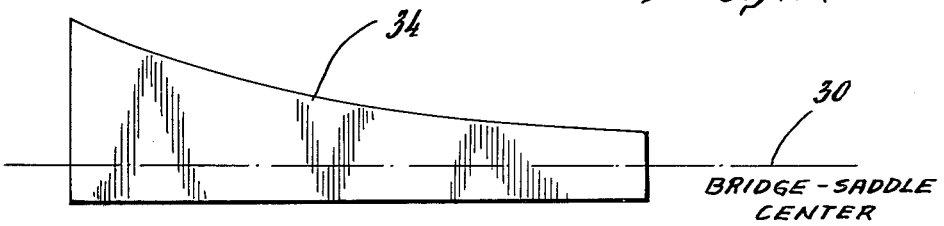
FIG. 5 is a top view of the profile of a bridge base of a second alternative embodiment of the invention.
Figure 6:
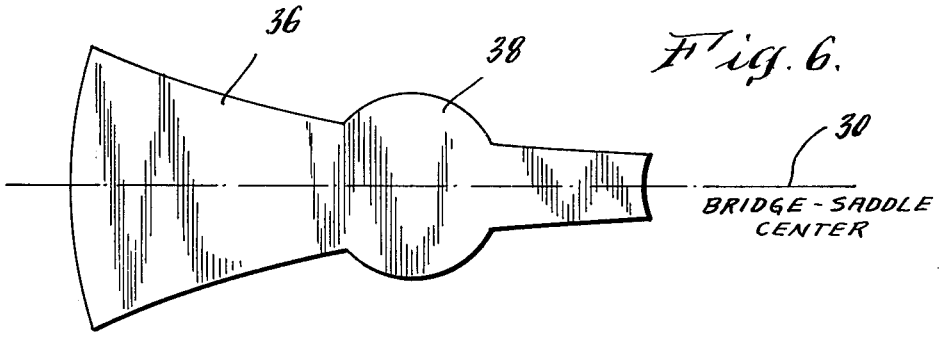
FIG. 6 is a top view of the profile of a bridge base of a third alternative embodiment of the invention.

FIG. 5 is a top-view profile of a radically asymmetric bridge of a second alternative embodiment of the invention. Again, the contour of this bridge is roughly the inverse of the contour of the curve shown in FIG. 2, the bridge thus providing substantially uniform mechanical compliance between the bridge and soundboard to all points along the length of the bridge. However, since this bridge does not have equal areas on opposite sides of the bridge's center axis, it tends to impart an asymmetric vibrational force to the sound board. There are, however, certain applications where the bracing structure of the soundboard is itself asymmetric. This design may, in these applications tend to compensate for the asymmetry in the soundboard design. It is noted that, depending on the asymmetry in the soundboard design which is to be compensated for, the distribution of mass on opposite sides of center line 30 may be varied between the uniform distribution shown in FIG. 3 and the radically asymmetric distribution shown in FIG. 5.

While the bridges shown and described above are intended to provide a substantially uniform response from the instrument over its full frequency range, the teachings of this invention may also be utilized to provide notches in the frequency response of the instrument. Thus, in FIG. 5, a bulge 38 has been provided in the bridge in the midrange frequency region thereof which bulge causes a higher mechanical impedance (lower mechanical compliance) for vibrations at these midrange frequencies than at other frequencies, resulting in a lower energy notch in the response of the instrument at these frequencies. The center frequency, the frequency range, and depth of this notch may be controlled by varying the size and shape of the bulge 38. Other predetermined variations in the shape of the bridge base profile may also be utilized to obtain predetermined frequency responses.

Figure 7:
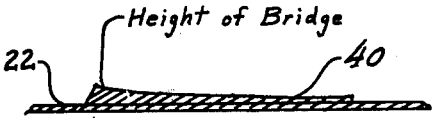
FIG. 7 is a sectional view of a bridge base for a fourth alternative embodiment of the invention.

FIG. 7 is a cross sectional view through center line 30 of a bridge base 40 of still another alternative embodiment of the invention. In the embodiments of the invention described above, the physical parameter of the bridge base which has been varied to obtain desired mechanical compliance at each point along the length of the bridge has been the bridge width. While bridge width is the ideal parameter to control since, fortuitously, variations in this parameter also result in the base being of optimum width to effectively couple vibrational forces to the soundboard at the frequency being coupled at the point, the desired control of mechanical compliance may also be obtained by varying other parameters of the bridge base. Thus, in FIG. 7, the height rather than the width of the bridge base is varied to achieve desired mechanical compliance values. Similar effects might be achieved by making the bridge more hollow at the treble end than at the bass end, by using less dense materials at the treble end than at the bass end, or by some combination of the above.

While, as previously indicated, the invention has been described above with respect to guitar embodiments, the teachings of this invention might be advantageously utilized on other stringed musical instruments as well. Further, while specific embodiments of the invention have been described above along with certain possible modifications thereon, other changes in form and detail may be made therein without departing from the spirit and scope of the invention.

What is claimed is:

1. In a stringed musical instrument having lower frequency or bass strings and higher frequency or treble strings, vibrations of the strings being coupled through a bridge to a soundboard, the mechanical compliance between the bridge and the soundboard at each point along the bridge from the bass end thereof to the treble end thereof being dependent on the frequency being coupled by the bridge to the soundboard at that point, a bridge having:

a first predetermined width at the bass end thereof, said width being sufficient to effectively couple the lowest frequency vibrations to be coupled by said bridge;

a second predetermined width at the treble end thereof, said second width being less than said first width and being sufficient to effectively couple the highest frequency vibrations to be coupled by said bridge; and a width at each point intermediate said bass and treble ends which is both sufficient to effectively couple the frequency coupled at that point and is selected such that the mechanical compliance between the bridge and the soundboard is substantially the same at all points along the bridge.

2. A bridge as claimed in claim 1 wherein the bridge is shaped so as to be asymmetric about its center axis.

3. A bridge as claimed in claim 1 wherein the bridge is shaped so as to be symmetric about its center axis.

4. A bridge as claimed in claim 1 wherein the width of said bridge at each point is selected such that the mechanical compliance at that point is as large as possible while still being of sufficient width to effectively couple the frequency coupled at that point.

5. A bridge as claimed in claim 1 wherein said bridge is particularly adapted for use as the bridge of an acoustic guitar.

6. In a stringed musical instrument having lower frequency or bass strings and higher frequency or treble strings, vibrations of the strings being coupled through a bridge to a soundboard, the mechanical compliance between the bridge and the soundboard at each point along the bridge from the bass end thereof to the treble end thereof being dependent on the frequency being coupled by the bridge to the soundboard at that point, a bridge the mechanical parameters of which are such, at each point along the bridge from the bass end thereof to the treble end thereof, that the mechanical compliance between the bridge and the soundboard is substantially the same at all said points.

7. In a stringed musical instrument having lower frequency or bass strings and higher frequency or treble strings, vibrations of the strings being coupled through a bridge to a soundboard, the mechanical compliance between the bridge and the soundboard at each point along the bridge from the bass end thereof to the treble end thereof being dependent on the frequency being coupled by the bridge to the soundboard at that point, a bridge which is adapted to be in intimate physical contact with the soundboard over its entire length, the bridge having a first predetermined width at the bass end thereof, said width being sufficient to effectively couple the lowest frequency vibrations to be coupled by said bridge; a second predetermined width at the treble end thereof, said second width being less than said first width and being sufficient to effectively couple the highest frequency vibration to be coupled by said bridge; and a width at each point intermediate said bass and said treble ends which is sufficient to effectively couple the frequency coupled at that point and is empirically determined by taking measurements over the octave range of the instrument for equivalent mechanical driving of the instrument so as to provide a selected mechanical compliance at that point.

* * * * *